US008143543B2

(12) United States Patent
Naas

(10) Patent No.: US 8,143,543 B2
(45) Date of Patent: Mar. 27, 2012

(54) ACTUATING ELEMENT

(75) Inventor: Nico Naas, Karlsruhe (DE)

(73) Assignee: Harman Becker Automotive Systems GmbH, Karlsbad (DE)

( * ) Notice: Subject to any disclaimer, the term of this patent is extended or adjusted under 35 U.S.C. 154(b) by 42 days.

(21) Appl. No.: 11/866,288

(22) Filed: Oct. 2, 2007

(65) Prior Publication Data

US 2010/0224470 A1 Sep. 9, 2010

(30) Foreign Application Priority Data

Oct. 2, 2006 (EP) ..... 06020770

(51) Int. Cl.
*H01H 13/70* (2006.01)

(52) U.S. Cl. ..... 200/345

(58) Field of Classification Search ..... 200/345, 200/5 A, 5 R, 517, 520
See application file for complete search history.

(56) References Cited

U.S. PATENT DOCUMENTS

| | | | | |
|---|---|---|---|---|
| 5,032,698 | A | 7/1991 | Satoh | |
| 6,969,815 | B1 * | 11/2005 | Lu | 200/345 |
| 7,332,681 | B2 * | 2/2008 | Wohlfart | 200/5 A |
| 2003/0150703 | A1 * | 8/2003 | Tsau | 200/345 |

FOREIGN PATENT DOCUMENTS

| | | | |
|---|---|---|---|
| GB | 2247989 | A | 3/1992 |
| WO | WO 00/46822 | A1 | 8/2000 |

* cited by examiner

*Primary Examiner* — Edwin A. Leon
(74) *Attorney, Agent, or Firm* — The Eclipse Group LLP

(57) ABSTRACT

An actuating element for controlling an electronic device is providing. The actuating element including a front cover having an actuating surface to be actuated by a user and a support structure adapted to be coupled to the front cover. The support structure having guiding rips that guide the movement of the actuating element in a housing upon actuation of the actuating element. The front cover having centering shoulders that contact the guiding rips for positioning the support structure relative to the front cover when the front cover is coupled to the support structure.

9 Claims, 4 Drawing Sheets

ACTUATING ELEMENT

RELATED APPLICATIONS

This application claims priority of European Patent Application Serial Number 06 020 770.1, filed on Oct. 2, 2006, titled ACTUATING ELEMENT, which application is incorporated in its entirety by reference in this application.

BACKGROUND OF THE INVENTION

1. Field of the Invention

This invention relates to an actuating element for controlling an electronic device.

2. Related Art

Actuating elements are commonly utilized for controlling the use of different electronic devices. When a predetermined function of the electronic device is to be changed, the actuating element is actuated. When the electronic device is incorporated into a vehicle, e.g., in a dashboard of a vehicle, limited space is provided for controlling the different features and functions of the electronic device. To this end, actuating elements are provided on the front cover facing the passenger compartment with which the driver or any other user can control the different functions of the electronic device. One kind of actuation is the pressing of the actuating element. When an actuating surface of the actuating element is pressed, the actuating force is transmitted to an electronic contact surface by the actual movement of the actuating element contacting a contact surface. Conventionally, these actuating elements are designed as one piece elements in order to make sure that the actuating force is correctly transmitted to the contact surface. When the actuating element consists of several pieces or elements, it may happen that due to the play existing between the different elements, an actuating force is not correctly transmitted to a contact surface. However, it may be preferable, be it of design aspects or be it due to the manufacturing process that an actuating element is desirable comprising more than one piece.

Accordingly, a need exists to provide an actuating element comprising more than one piece that nevertheless reliably transmits the actuating force when a user actuates the actuating element.

SUMMARY

In one implementation, an actuating element for controlling an electronic device is provides that includes a support structure adapted to be coupled to a front cover. The front cover having an actuating surface to be actuated by a user. The support structure further includes guiding rips guiding the movement of the actuating element in a housing upon actuation of the actuating element. The front cover additionally includes centering shoulders that contact the guiding rips for positioning the support structure relative to the front cover when the front cover is coupled to the support structure.

Other devices, apparatus, systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE FIGURES

The invention may be better understood by referring to the following figures. The components in the figures are not necessarily to scale, emphasis instead being placed upon illustrating the principles of the invention. In the figures, like reference numerals designate corresponding parts throughout the different views.

DETAILED DESCRIPTION

Figure 1:
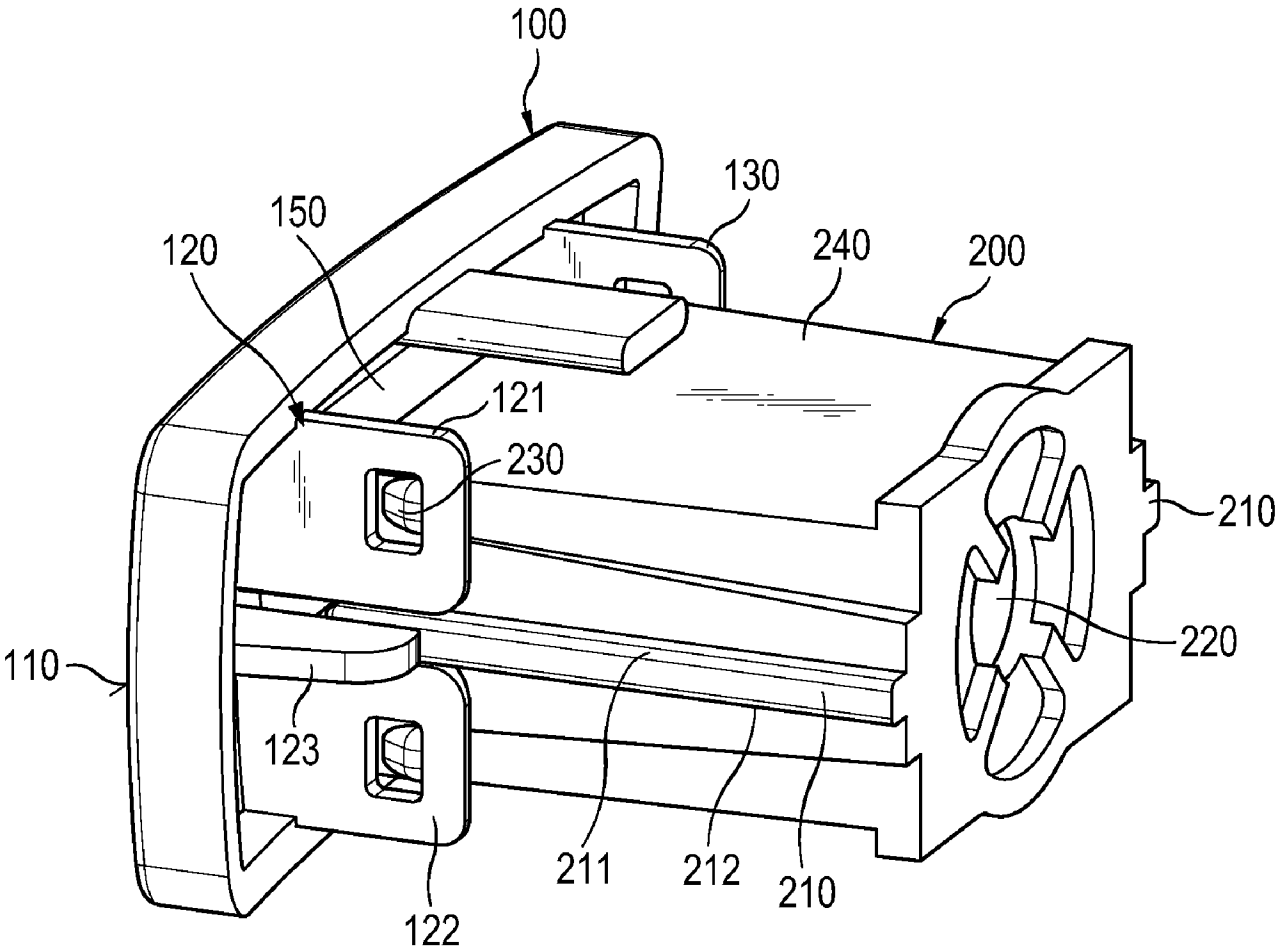
FIG. 1 shows a rear perspective view of a two-piece actuating element including a front cover and a support structure.

FIG. 1 is a perspective view of an actuating element. The actuating element includes a front cover 100 and a support structure 200 that is connected to the front cover 100. In the illustrated example of FIG. 1, the support structure 200 is coupled to the back surface of the front cover 100.

In operation, the actuating element is installed in a housing (not shown) of an electronic device, the actuating element being used for selecting a predetermined feature or function of the electronic device. By way of example, the actuating element may be utilized in a housing of a multimedia system incorporated into a vehicle, the multimedia system may, for example, include a radio receiver, a telecommunication module, a navigation module for guiding a user to a predetermined destination, or other electronic device. The actuating element is not, however, limited to in-vehicle applications. The actuating element may be used in connection with any electronic device for which an actuating element is utilized to control the functioning of the electronic device.

Figure 2:
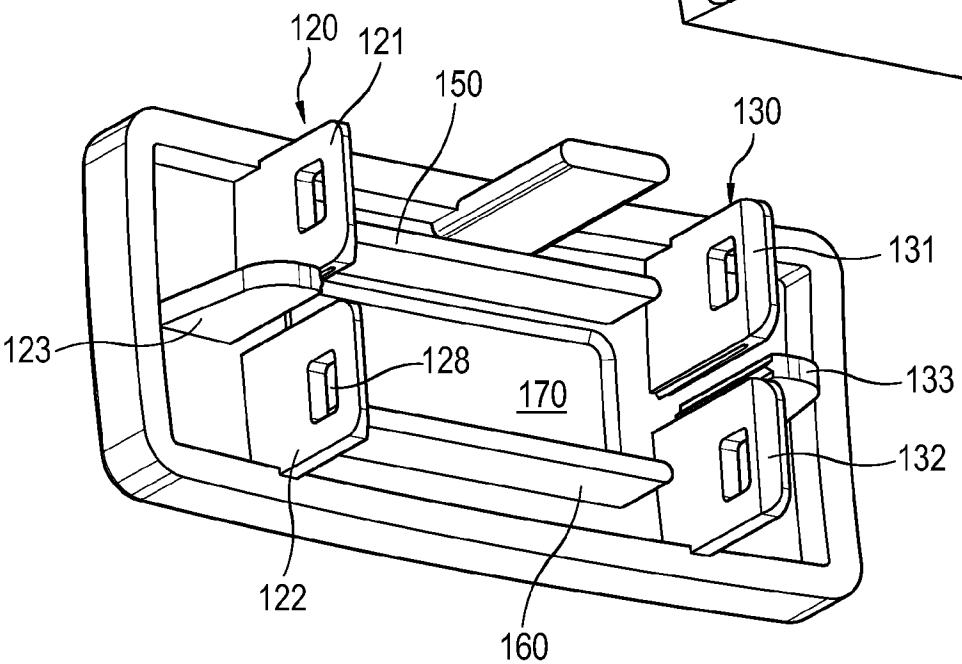
FIG. 2 is a rear perspective view of the back surface of the front cover.
Figure 5:
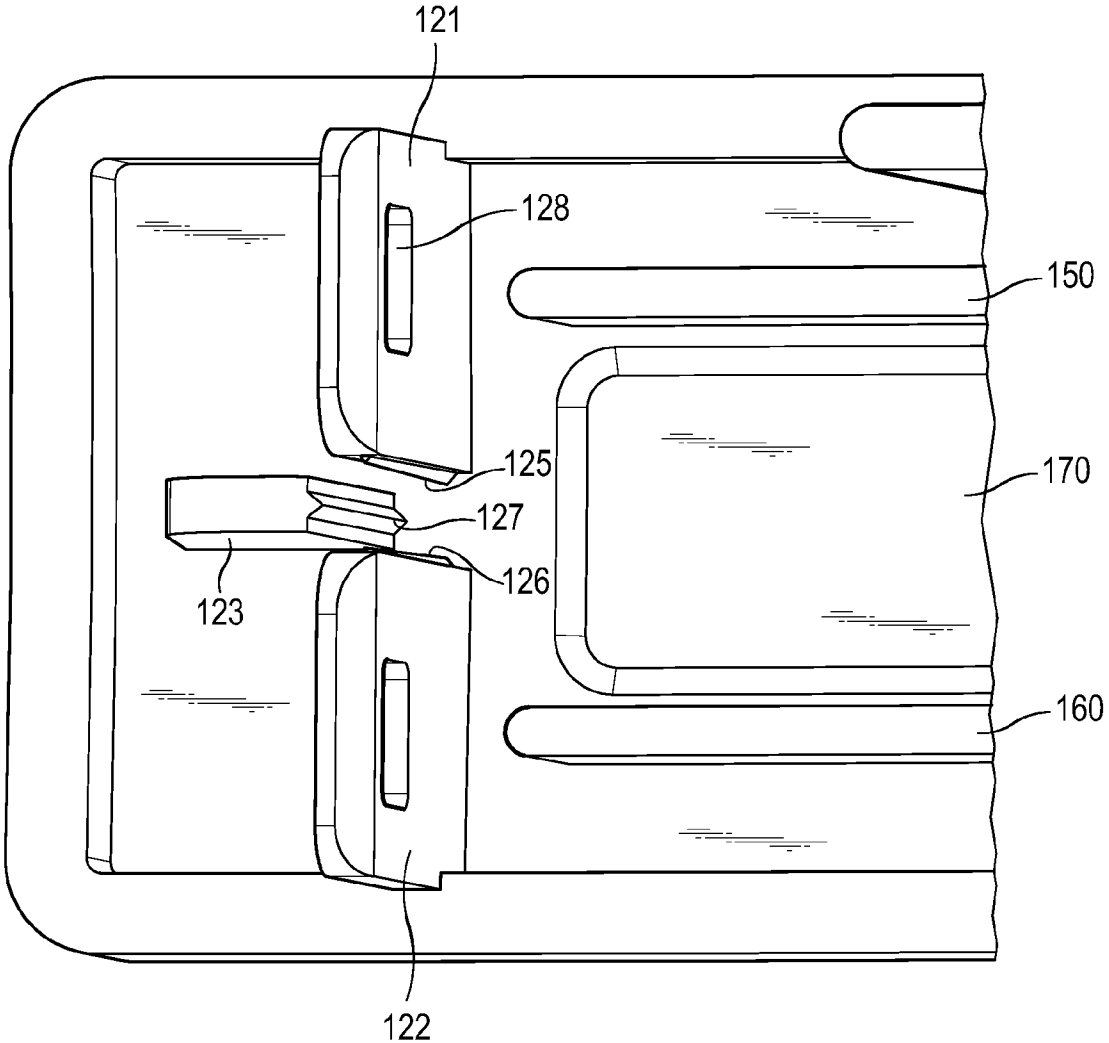
FIG. 5 is an enlarged cut-away view showing the back surface of the front cover of the actuating element.

As illustrated in FIGS. 1, 2 and 5, the front cover 100 includes, on its back surface, two groups 120 and 130 of centering shoulders. Each group 120 and 130 of centering shoulders comprises three different shoulders. The first group 120 of shoulders including centering shoulders 121, 122 and 123 and the second group of shoulders including centering shoulders 131, 132 and 133. Accordingly, the two groups 120 and 130 centering shoulders 121, 122, 123 and 131, 132, 133 project from the back surface of the front cover 100 opposite the actuating or front surface 110.

As further illustrated in FIGS. 1, 2 and 5, two additional cover guiding rips 150 and 160 are also provided on the back surface of the front cover 100. Further, a recessed portion 170 may also be provided in the middle portion of the back surface of the front cover 100 between the cover guiding rips 150 and 160.

Figure 3:
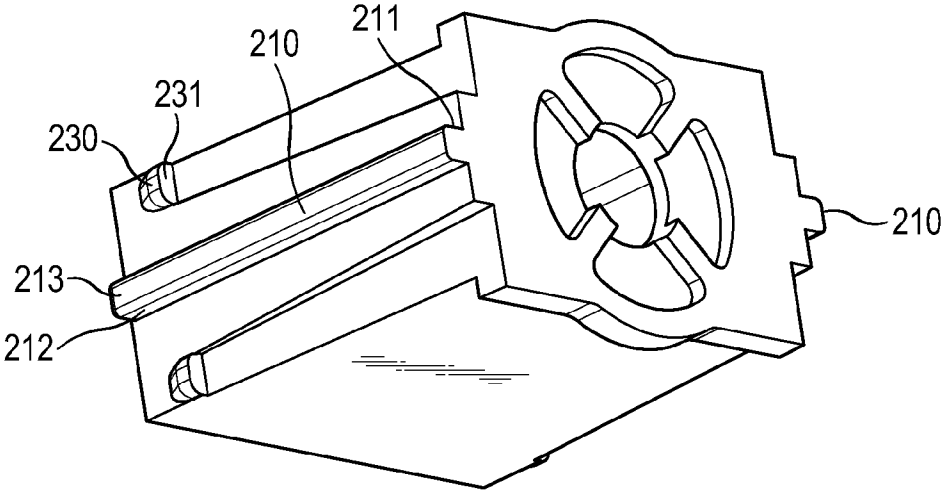
FIG. 3 is a perspective view of the support structure.

As illustrated in FIGS. 1 and 3, the support structure 200 may have a substantially rectangular housing with two guiding rips 210 on the respective side surfaces of the support structure 200. The two guiding rips 210 extend along the side surfaces for guiding the movement of the actuating element in a housing of an electronic device (not shown) when a user pushes the actuating element. These two guiding rips 210 may be positioned in a corresponding guiding structure in the housing in which the actuating element is utilized. With the two opposite guiding rips 210, the actuating element can move in the housing upon actuation.

Each guiding rip 210 may have three contact surfaces, an upper contact surface 211, a lower contact surface 212 and the side contact surface 213. When the support structure is connected to the front cover by moving the front cover in the direction of the support structure, projections 230 provided on the side surface of the support structure engage the recess for fixedly connecting the support structure to the front cover. As can be seen in detail in FIG. 3, the projections comprise a surface extending substantially perpendicular to the side surface, this perpendicular surface serving as a notch for the recess provided on the centering shoulders. As can be seen in the figures, two projections 230 having lips 231 are provided on each side surface of the support structure 200 for engaging the front cover 100 of the actuating element.

As also illustrated in FIGS. 1 & 3, the support structure 200 includes an opening 220 that allows the support structure 200 to be utilized as a reflector. In this regard, light from a light source (not shown) may enter the support structure 200 through the opening 220 and be reflected inside the support structure 200. The light reflected in the support structure 200 may then be used to illuminate the front cover 100 so that a user is able to locate the front or actuating surface 110 of the front cover 100 in a dark environment.

Figure 4:
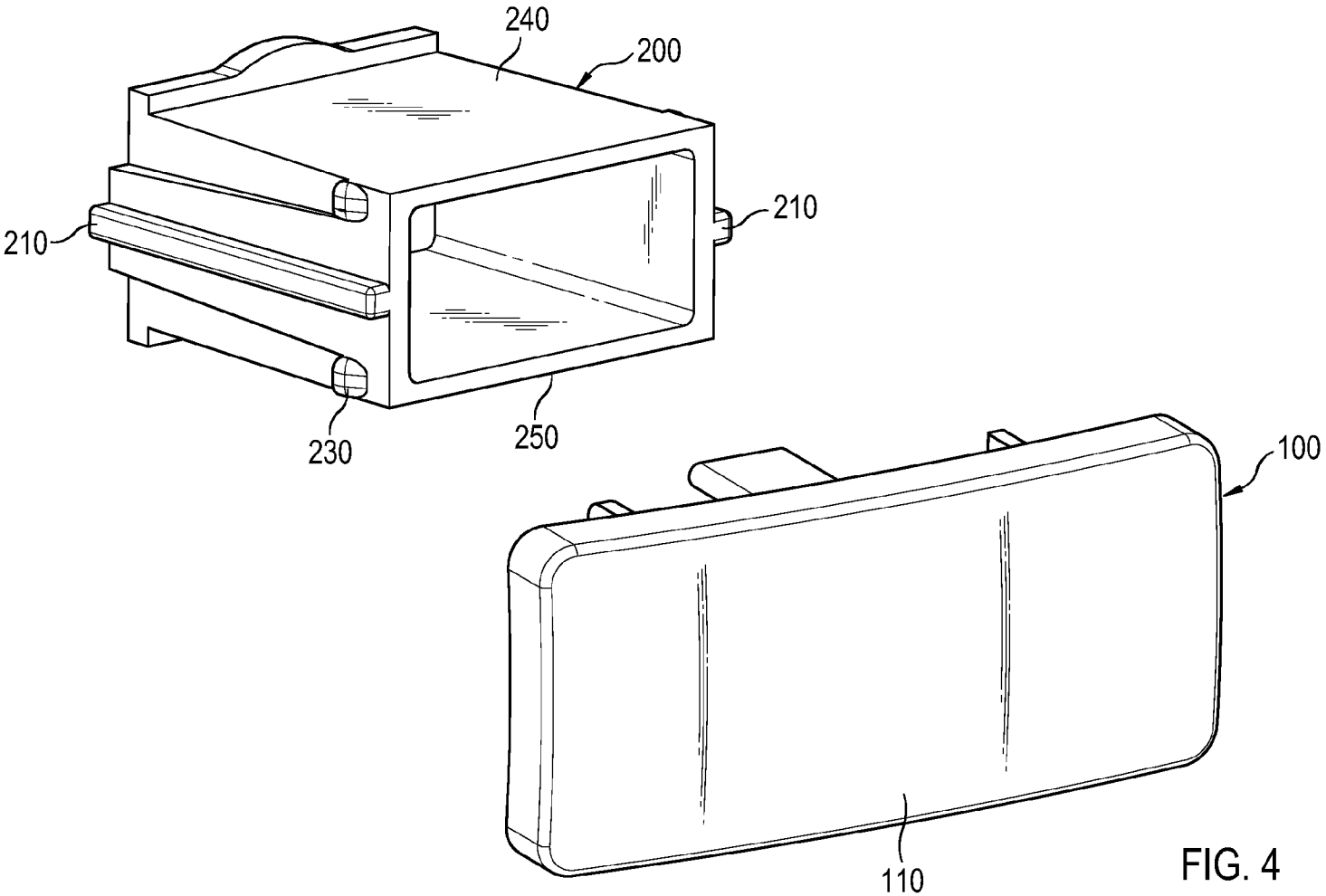
FIG. 4 is a front perspective view of the front cover removed from the support structure.

FIG. 4 is a front perspective view of the front cover removed from the support structure. In FIG. 4, the front cover 100 is shown detached from the support structure 200. As can be seen, the support structure 200 may be a hollow body having a rectangular front surface which is connected to the back surface of the front cover 100. The front cover 100 includes a large actuating surface 110 which may be actuated by the user.

As further illustrated in FIG. 4, the support structure 200 includes an upper side 240 and a lower side 250. When the support structure is connected to the front cover, these upper and lower sides 240 to 250 are received between two cover guiding rips 150 and 160 of the front cover 100, which is illustrated in detail in FIGS. 2 & 5. These two cover guiding rips 150 and 160 guide the upper and the lower sides 240 and 250 of the support structure 200 in engagement with the front cover 100, as seen in FIG. 1, where it is illustrated that the guiding rip 150 contacts the outer surface of the upper side 240 of the support structure 200.

FIG. 5 is an enlarged cut-away view showing the back surface of the front cover of the actuating element. In FIG. 5, the centering shoulders 121, 122 and 123 are shown in more detail. In the illustrated example, each of the centering shoulders 121, 122 and 123 includes on its interior surface (i.e., the surfacing engaging the guiding rips 210 of the support structure 200) a projecting rip 125, 126 and 127. For example, centering shoulder 121 includes projecting rip 125, centering shoulder 122 includes protecting rip 126 and centering shoulder 123 includes projecting rip 127. These projecting rips 125, 126 and 127 are dimensioned in such a way that, when the guiding rip 210 is inserted in the free space between the centering shoulders 121, 122 and 123, a tight fit of the centering shoulders 121, 122 and 123 and the guiding rip 210 may be obtained. In this manner, the projecting rips 125, 126 and 127 may provide a fit with the guiding rip 210 that reduces play between front cover 100 and the support member 200 when engaged.

As illustrated above, in connection with FIGS. 1-5, the three centering shoulders 121, 122 and 123 and 131, 132 and 133 of each group of the front cover 100 are positioned in such a way that they delimit a space in which the guiding rip 210 of the support structure 200 can be positioned when the front cover 100 is engaged with the support structure 200. Further, one group of center shoulders 121, 122 and 123 may be used to position one guiding rip 210, while the other group of center shoulders 131, 132 and 133 may be used to positioning the other guiding rip 210 relative to the front cover 100. Each group of centering shoulders 121, 122 and 123 and 131, 132 and 133 then determines the position of the front cover 100 relative to the support structure 200 and the position of the support structure 200 is then fixed at two different locations, i.e. the locations of the guiding rips 210. For an interference fit of the guiding rips 210 between the centering shoulders 121, 122 and 123 and 131, 132 and 133, each centering shoulder may additionally include a projecting rip 125, 126 and 127 on the surface of the centering shoulder 121, 122 and 123 and 131, 132 and 133 on which the centering shoulder 121, 122 and 123 and 131, 132 and 133 contacts the guiding rip 210. These projecting rips 125, 126 and 127 on the centering shoulders 121, 122 and 123 and 131, 132 and 133 help to provide a press fit between the guiding rips 210 and the centering shoulders 121, 122 and 123 and 131, 132 and 133.

In the illustrated implementation, each guiding rip 210 of the support structure including three different guiding surfaces 211, 212 and 213, one centering shoulder 121, 122, 123 or 131, 132 and 133 being provided for each surface 211, 212 and 213 of a guiding rip 210. In this manner, the centering shoulders 121, 122, 123 and 131, 132 and 133 contact the guiding rips 210 at three different sides or surfaces 211, 212 and 213 so that the position of the support structure 200 relative to the front cover 100 is determined in these three different directions.

Further, as illustrated, the two centering shoulders 121, 122 and 131 and 132 contact the side surfaces of the support structure 200. The two centering shoulders 121, 122 and 131, 132 contacting the side surface of the support structure 200 above and below the guiding rips 210 include a recess 128 (see FIGS. 2 and 5). Thus, when the support structure 200 is connected to the front cover 100 by moving the front cover 100 in the direction of the support structure 200, projections 230 provided on the side surface of the support structure 200 engage the recess 128 for fixedly connecting the support structure 200 to the front cover 100. As can be seen in detail in FIG. 3, the projections 230 include a rib or surface 231 extending substantially perpendicular to the side surface of the support structure 200, this perpendicular surface serves as a notch for the recess provided on the centering shoulders 121, 122 and 131, 132. As can be seen in the figures, two or more projections 230 may be provided on each side surface of the support structure 200, each projection engaging a recess 128.

The six centering shoulders 121, 122, 123 and 131, 132, 133 together with the projecting rips 125, 126 and 127 (FIG. 5) provided on each centering shoulder 121, 122, 123 and 131, 132, 133 allow a tight fit of the front cover 100 on the support structure 200. This tight fit is obtained by the centering shoulders 121, 122, 123 and 131, 132, 133 in connection with the guiding rips 210 and the guiding rips 210, at the same time, guiding the movement of the combined actuating element upon activation by the user. Thus, the play between the housing and the actuating element may be minimized, as the amount of play depends primarily upon the play between the guiding rips 210 and the housing.

In the illustrated example of an implementation of the actuating element, the centering shoulders 121, 122 and 123 and 131, 132 and 133 are arranged in such a way that two centering shoulders 121, 122 and 131, 132 of each group 120 and 130 limit the movement of the support structure 200 relative to the front cover 100 in a first direction, whereas a third centering shoulder 123 and 133 of each centering group 120 and 130 limits the movement of the support structure 200 relative to the front cover 100 in a second direction substantially perpendicular to the first direction. In this illustrated implementation, each group 120 and 130 includes three centering shoulders 121, 122 and 123 and 131, 132 and 133, so that in total six centering shoulders 121, 122 and 123 and 131, 132 and 133 are provided. In total, four of the centering shoulders 121, 122 and 131, 132 restrict the movement of the support structure 200 relative to the front cover 100 in one direction, e.g., the vertical direction, while two of the centering shoulders 123 and 133 limit the movement of the support structure 200 relative to the front cover 100 in the horizontal direction.

In the illustrated example, the two centering shoulders 121, 122 and 131, 132 limit the movement of the guiding rip 210 and therefore the movement of the support structure 100 in a direction that is shown to be the vertical direction in the figures. The centering shoulder 123 together with the other centering shoulder 133, limit the movement and the play of the support structure 200 relative to the front cover 100 in the direction perpendicular to the vertical direction which, in the implementation shown, is the horizontal direction. It should, however, be understood that the actuating element can also be inserted into a housing by a 90 degree shift so that the horizontal direction would be the vertical direction and vice versa.

Additionally, to connect the front cover 100 to the support structure 200, some of the centering shoulders 121, 122 and 123 and 131, 132 and 133 may include recesses. A projection provided on the support structure 200 can then engage the recesses for securing the front cover 100 to the support structure 200. Furthermore, it is possible that some of the centering shoulders 121, 122 and 123 and 131, 132 and 133 be arranged substantially parallel to the side surface of the support structure 200 from which the guiding rips 210 extend, whereas other centering shoulders 121, 122 and 123 and 131, 132 and 133 may extend substantially perpendicular to the side surface of the support structure 200. It is also possible that all the centering shoulders 121, 122 and 123 and 131, 132 and 133 extend substantially parallel to the side surface of the support structure 200.

Because the front cover 100 is coupled to the support structure 200 via the contact of the guiding rips 210, and the guiding rips 210 act also to guide the movement of the actuating element into the housing of the electronic devise, a high amount of precision and stability may be obtained from the actuating element, similar to the function provided by a one-piece actuating element. In the illustrated design, the centering shoulders 121, 122 and 123 and 131, 132 and 133 position the support structure 200 relative to the front cover 100 with minimal play. Accordingly, the guiding rips 210 play a double role. First, the guiding rips 210 guide the movement of the complete actuating element upon its actuation, and second, the guiding rips 210 help to connect the front cover 100 to the support structure 200. With this double role of the guiding rips 210, a precise guiding of the two-piece actuating element in the housing may be obtained. In case of an actuation, the actuating element may reliably transmit the contact force to a contact surface provided behind the actuating element. The contact forces may then be transmitted as reliably as with the one-piece actuating element.

The foregoing description of implementations has been presented for purposes of illustration and description. It is not exhaustive and does not limit the claimed inventions to the precise form disclosed. Modifications and variations are possible in light of the above description or may be acquired from practicing the invention. The claims and their equivalents define the scope of the invention.

What is claimed is:

1. An actuating element for controlling an electronic device, comprising:

a support structure having at least one surface extending from a first end to a second end to form a support structure housing having at least one guiding rip projecting lengthwise from the at least one surface and a first fixing structure;

a front cover having a second fixing structure and centering shoulders for contacting the guiding rip for positioning the support structure housing relative to the front cover when the front cover is coupled to the first end of the support structure by engaging the first fixing structure on the support structure to the second fixing structure on the front cover, the front cover and support structure being fixedly engaged to move as a unit during actuation.

2. The actuating element of claim 1, where the guiding rip has an upper, lower and side surface and where each of the centering shoulders contacts a different surface of the guiding rip.

3. The actuating element of claim 1, where the support structure has two opposing side surfaces and one guiding rip is positioned on each of the opposing side surfaces.

4. The actuating element of claim 1, where two groups of centering shoulders are provided on the front cover, one group of centering shoulders positioned to engage one guiding rip and the other group of centering shoulders positioned to engage the other guiding rip.

5. The actuating element of claim 1, where each centering shoulder further includes a projecting rip provided on a surface of the centering shoulder that contacts the guiding rip.

6. The actuating element of claim 1, where the centering shoulders includes a group of at least three centering shoulders and where two centering shoulders of in the group of centering shoulders limit the movement of the support structure relative to the cover in a first direction, whereas a third centering shoulder of the group of centering shoulders limits the movement of the support structure relative to the cover in a second direction substantially perpendicular to the first direction.

7. The actuating element of claim 1 , where the front cover has a back surface and an actuating surface and where the centering shoulders project from a back surface of the front cover.

8. The actuating element of claim 1, where the centering shoulders includes a group of centering shoulders and where at least one of the centering shoulders are extends substantially parallel to a side surface of the support structure from which the guiding rip extends and at least one centering shoulder extends substantially perpendicular to said side surface.

9. The actuating element according to claim 1, where the first fixing structure includes a projection on the support structure and the second fixing structure includes a recess on the centering shoulder where the recess of the centering shoulder engages the projection on the support structure when securing the front cover to the support structure.

* * * * *

UNITED STATES PATENT AND TRADEMARK OFFICE

CERTIFICATE OF CORRECTION

PATENT NO. : 8,143,543 B2
APPLICATION NO. : 11/866288
DATED : March 27, 2012
INVENTOR(S) : Naas It is certified that error appears in the above-identified patent and that said Letters Patent is hereby corrected as shown below:

In the Abstract, "...device is providing..." should be changed to -- device is provided --.

In FIG. 2, the front cover should be labeled with reference numeral 100.

In FIG. 3, the support structure should be labeled with reference numeral 200.

In FIG. 3, the opening of the support structure 200 should be labeled with reference numeral 220.

In FIG. 5, the front cover should be labeled with reference numeral 100.

At column 1, line 47, "...device is provides..." should be changed to -- device is provided --.

At column 2, line 64, "...the support structure is..." should be changed to -- the support structure 200 is --.

At column 2, line 65, "...the front cover by..." should be changed to -- the front cover 100 by --.

At column 3, line 2, "...the projections comprise..." should be changed to -- the projections 230 comprise --.

At column 3, line 18, "...the front cover..." should be changed to -- the front cover 100 --.

At column 3, line 19, "...the support structure. In..." should be changed to -- the support structure 200. In --.

At column 3, line 28, "...the front cover,..." should be changed to -- the front cover 100, --.

At column 3, line 29, "...sides 240 to 250..." should be changed to -- sides 240 and 250 --.

Signed and Sealed this
Twenty-ninth Day of January, 2013

David J. Kappos

David J. Kappos
*Director of the United States Patent and Trademark Office*

At column 3, line 38, "...the front cover of..." should be changed to -- the front cover 100 of --.

At column 3, line 57, "...each group of..." should be changed to -- each group 120 and 130 of --.

At column 3, line 61, "...one group of..." should be changed to -- one group 120 of --.

At column 3, line 62, "...the other group of..." should be changed to -- the other group 130 of --.

At column 3, line 63, "...may be used to positioning..." should be changed to -- may be used to position --.

At column 3, line 65, "...group of..." should be changed to -- group 120 and 130 of --.

At column 4, line 13, "...the illustrated implementation..." should be changed to -- the illustrated implementation in FIG. 3 --.

At column 4, line 14, "...the support structure including..." should be changed to -- the support structure 200 including --.

At column 4, line 37, "...for the recess provided..." should be changed to -- for the recess 128 provided --.

At column 5, line 22, "...may include recesses. A projection..." should be changed to -- may include recesses 128. A projection 230 --.

At column 5, line 24, "...recesses for..." should be changed to -- recesses 128 for --.